US011167301B2

(12) United States Patent
Alluigi

(10) Patent No.: US 11,167,301 B2
(45) Date of Patent: Nov. 9, 2021

(54) TRIGGER DISPENSING HEAD WITH LOCKING DEVICE

(71) Applicant: GUALA DISPENSING S.P.A., Alessandria (IT)

(72) Inventor: Riccardo Alluigi, Alessandria (IT)

(73) Assignee: GUALA DISPENSING S.P.A., Alessandria (IT)

( * ) Notice: Subject to any disclaimer, the term of this patent is extended or adjusted under 35 U.S.C. 154(b) by 0 days.

(21) Appl. No.: 16/771,010

(22) PCT Filed: Sep. 7, 2018

(86) PCT No.: PCT/IB2018/056832
§ 371 (c)(1),
(2) Date: Jun. 9, 2020

(87) PCT Pub. No.: WO2019/116115
PCT Pub. Date: Jun. 20, 2019

(65) Prior Publication Data

US 2021/0107024 A1 Apr. 15, 2021

(30) Foreign Application Priority Data

Dec. 15, 2017 (IT) ..... 102017000144923

(51) Int. Cl.
*B05B 11/00* (2006.01)

(52) U.S. Cl.
CPC ..... *B05B 11/3059* (2013.01); *B05B 11/3057* (2013.01)

(58) Field of Classification Search
CPC ..... A61B 17/3403; A61B 2017/3407; A61B 2017/3413; A61B 6/032; A61B 8/4209; A61B 8/4227; A61B 8/4281; A61B 8/4411; A61B 8/4461; A61B 8/4477; A61B 90/50; B05B 11/3011; B05B 11/3057; B05B 11/3059; B05B 11/3074; B05B 11/3077; B05B 11/306; G10K 11/004; G10K 11/352; G10K 11/355
See application file for complete search history.

(56) References Cited

U.S. PATENT DOCUMENTS 5,332,128 A * 7/1994 Mass ..... B05B 11/3077 222/383.1
5,722,569 A * 3/1998 Foster ..... B05B 11/3011 222/153.13

(Continued)

FOREIGN PATENT DOCUMENTS

| | | | |
|---|---|---|---|
| DE | 9315579 | U1 | 12/1993 |
| JP | 2000135457 | A | 5/2000 |
| JP | 2008036488 | A | 2/2008 |

OTHER PUBLICATIONS

International Search Report, issued in PCT/IB2018/056832, dated Nov. 6, 2018, Rijswijk, Netherlands.

*Primary Examiner* — Vishal Pancholi
*Assistant Examiner* — Bob Zadeh
(74) *Attorney, Agent, or Firm* — Arent Fox LLP; Michael Fainberg

(57) ABSTRACT

A trigger dispensing head for a liquid dispensing device includes a chassis, a trigger, elastic return means having a return element supported by the chassis, and a reversible locking device. The locking device is supported by the return element of a non-return element.

14 Claims, 5 Drawing Sheets

(56) References Cited

U.S. PATENT DOCUMENTS

| | | | | |
|---|---|---|---|---|
| 5,984,149 | A * | 11/1999 | Thanisch | B05B 11/3077 222/340 |
| 6,286,723 | B1 * | 9/2001 | Sweeton | B05B 11/3057 222/153.13 |
| 7,478,739 | B2 * | 1/2009 | Foster | B05B 11/3011 222/383.1 |
| 2006/0054642 | A1 * | 3/2006 | Buti | B05B 11/3074 222/383.1 |
| 2008/0116222 | A1 | 5/2008 | Alluigi | |
| 2009/0152304 | A1 * | 6/2009 | Foster | B05B 11/3011 222/340 |
| 2014/0183283 | A1 | 7/2014 | Tada | |
| 2016/0228900 | A1 | 8/2016 | Gonzalez | |

* cited by examiner

TRIGGER DISPENSING HEAD WITH LOCKING DEVICE

CROSS-REFERENCE TO RELATED APPLICATIONS

This application is a National Phase Application of PCT International Application No. PCT/IB2018/056832, having an International Filing Date of Sep. 7, 2018 which claims priority to Italian Application No. 102017000144923 filed Dec. 15, 2017, each of which is hereby incorporated by reference in its entirety.

FIELD OF THE INVENTION

The object of the present invention is a trigger-type dispensing head for a dispensing device, intended, in particular, for the containment of liquid products, for example, for the purposes of household hygiene, the treatment of textiles, for example, before ironing or for the removal of stains, for gardening, for hair care, and the like.

BACKGROUND OF THE INVENTION

Even for such sectors, online sales to the final consumer are becoming enormously popular, posing some problems that were less felt in the past, even though they were present.

Among others, for example, there is a particular need to ensure that the dispensing device does not leak during careless transport operations, such as those that may occur for individual dispensing devices by a courier to the final consumer.

Usually, leakage occurs through the venting path in the dispensing head, i.e. through the path that allows air to enter the bottle when the liquid is aspirated. In effect, during transport the trigger may be accidentally pressed and therefore releases access from the bottle to the external environment through the venting path.

It is therefore essential to equip the dispensing head with a locking device that prevents the trigger from moving until the user unlocks it.

It is also desirable that the locking device is also reversible, so that the end user can activate or deactivate it at will.

There exist a number of trigger locking solutions for dispensing heads. For example, the solution illustrated in JP 2000135457, wherein a rotatable locking device is applied to the cover of the dispensing head, is well known.

However, as is well known, given the very high production volumes required, a further requirement of the sector is to assemble the head components in an extremely fast and reliable manner to avoid any breaks in production.

SUMMARY OF THE INVENTION

The object of the present invention is to produce a dispensing head equipped with a locking device that satisfies the aforesaid requirements and overcomes the drawbacks highlighted by the solutions of the prior art.

Such object is achieved by the dispensing device described in detail below. Advantageous embodiments of the invention are also described.

BRIEF DESCRIPTION OF THE DRAWINGS

The features and advantages of the dispensing device according to the present invention will be apparent from the description given below, provided by way of non-limiting example, in accordance with the accompanying figures, wherein.

DETAILED DESCRIPTION

Figure 1:
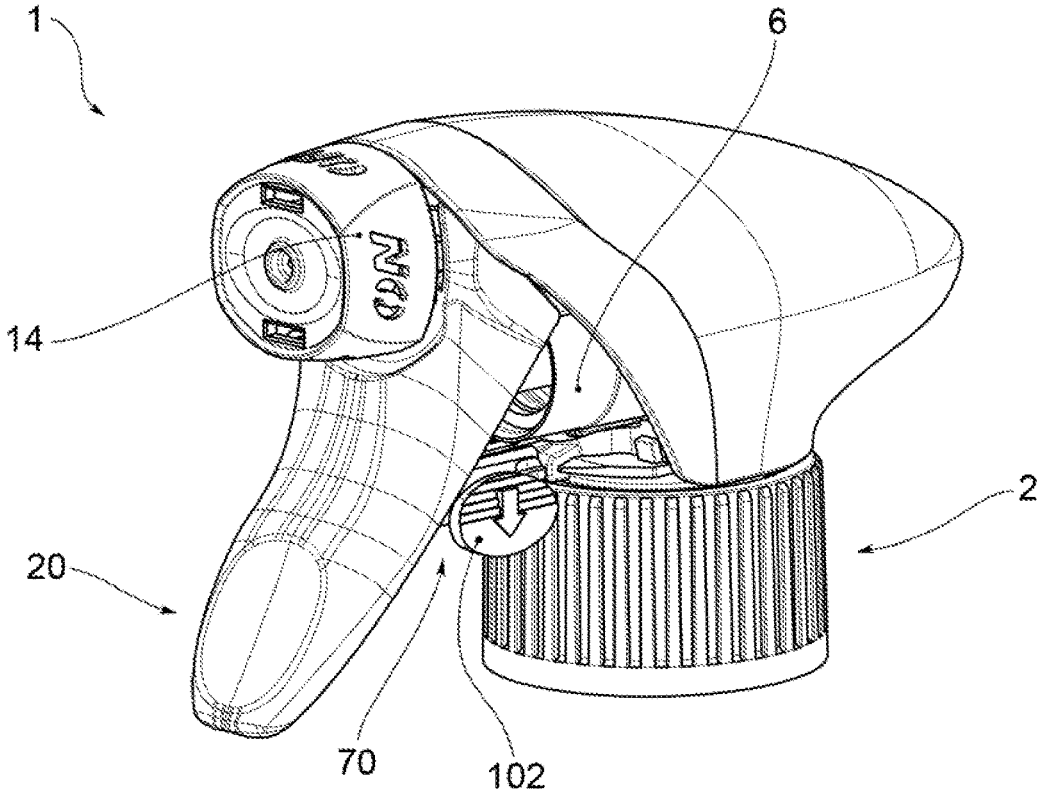
FIG. 1 shows a dispensing head according to the present invention, in accordance with one embodiment, provided with a locking device in a locked configuration.

With reference to the accompanying figures, a trigger dispensing head is indicated collectively at 1.

The head 1 is attachable to a bottle (not represented) in a removable manner.

The bottle comprises a bottle body with an internal bottle compartment for containing the liquid and a bottle neck for attaching the head 1. For example, the head 1 is equipped with a threaded ring 2 for screwing to the neck of the bottle.

The head 1, moreover, comprises a support frame or chassis 4 wherein are made or whereby are supported functional components of the head 1 for aspirating and dispensing the liquid.

In particular, the chassis 4 comprises a cylinder 6, comprising a cylinder wall delimiting an inner chamber, in which slides a piston 8 of the head 1; said piston is slidable along a piston axis X.

In particular, the piston 8 comprises a piston head and at least one seal applied to the piston head so that said piston is sealably slidable in the cylinder 6.

The head 1 also comprises a dispensing duct 10, for example, located in the chassis 4, in communication with the cylinder chamber 6 for dispensing the liquid to the outside.

Preferably, the dispensing duct 10 extends along a dispensing axis Y, preferably parallel to and spaced from the piston axis X.

The dispensing duct 10 ends with a dispensing opening 12, to which a nozzle 14 of the head 1 is applied.

In addition, the head 1 comprises dispensing valve means, applied to the chassis 4 and operating along said dispensing duct, adapted to allow the passage of the liquid from the cylinder chamber 6 to the dispensing duct 10 during a stage of dispensing the liquid to the outside and adapted to close the communication between the dispensing duct 10 and said chamber in a stage of aspirating the liquid from the bottle.

Moreover, the head 1 comprises a suction duct, e.g. made in the chassis 4, to put the bottle compartment in communication with the cylinder chamber 6.

The head 1 further comprises suction valve means, applied to the chassis 4 and operating along said suction duct, adapted to allow the passage of the liquid from the bottle compartment to the cylinder chamber 6 during a stage of aspirating the liquid and adapted to close the communication between the suction duct and said chamber in a stage of dispensing the liquid.

The head 1 also comprises a venting path, for example, formed in the chassis 4, to put the bottle compartment in communication with the external environment; in particular, said venting path extends from an outlet opening, which unlocks said path in the bottle compartment, to an inlet opening formed through the cylinder wall of the cylinder 6.

When the piston 8 is in the initial position, before completing the dispensing stroke, and preferably also for an initial stretch of the dispensing stroke, the piston seals are upstream of the inlet opening of the venting path, which is therefore separated from the external environment; in such condition, the air does not enter in the bottle compartment and the liquid present in the bottle compartment cannot escape to the outside through the venting path.

During an end stretch of the dispensing stroke, the piston seals are downstream of the inlet opening of the venting path, which is thus in communication with the external environment; in such condition, the air enters the bottle compartment to compensate the suction of liquid towards the cylinder chamber 6, and the liquid could escape to the outside via the inlet opening, for example in the case wherein the dispenser is turned upside down.

The head 1 further comprises a trigger 20, for example, supported by the chassis 4, movable by the user between an initial rest position and a final dispensing position along a dispensing stroke for dispensing the liquid. During the dispensing stroke, the trigger 20 acts on the piston 8, causing it to slide in the chamber 6.

Preferably, the trigger 20 is hinged to the chassis 4, for example in a region along the dispensing duct 10.

The trigger 20 is engageable with the piston 8, preferably through an articulated engagement 22 between a spherical piston end 24 and an engagement seat 26 of the trigger 20, into which the piston end 24 is snapped.

The head further comprises elastic return means permanently engaged with the trigger 20 to bring said trigger 20 back into the initial rest position.

In particular, the return means are adapted to engage the trigger 20, for example in an engagement area of the trigger 20, such as located above the engagement seat 26 with the piston 8.

The return means, preferably, comprise a return element 30 at least partially deformable elastically under the action of the user on the trigger.

According to a preferred embodiment, said return element 30 comprises an engagement portion 32 for the engagement with the trigger 20; for example, said engagement portion 32 is a section extending predominantly along a direction K orthogonal to the piston axis X.

In addition, said return element 30 comprises two arms 34, 36, each protruding from the end of the engagement portion 32, so as to be arranged alongside the cylinder 6.

Moreover, said return element 30 comprises two arched portions 38, 40, each forming an extension of the respective arm 34, 36, on the side opposite the engagement portion 32.

The return element 30 further comprises abutment portions 42, 44, each provided on the respective arched portion 38, 40, preferably at the end thereof distal from the connector with the respective arms 34, 36; said abutment portions 42, 44 are adapted to make an abutment for the return element during elastic deformation.

The return element 30 preferably comprises means for coupling the head 1 to the chassis 4.

For example, such coupling means comprise a coupling portion 46 of said return element 30, to which the two arched portions 42, 44 are joined; preferably, said coupling portion 46 comprises two hooks 48, 50 for gripping on the chassis 4.

Overall, when the return element 30 is mounted to the chassis 4, the return element 30 is arranged astride the cylinder 6, is substantially symmetrical with respect to an imaginary plane that contains the piston axis X and the dispensing axis Y and abuts with a portion of the chassis 4 via the abutment portions 42, 44 and is coupled thereto by the hooks 48, 50.

In particular, preferably, the chassis 4 comprises an intermediate region 52, located below the cylinder 6, through which are formed, at least in part, the venting path and the suction duct, and, below this, a mounting plate 54, having extension on an imaginary plane orthogonal to the imaginary plane that contains the piston axis X and the dispensing axis Y.

The plate 54 has superficially a step 56 on the face turned towards the cylinder 6, against which the abutment portions 42, 44 of the return element 30 abut.

The plate 54 also has a plate edge 58, to which the hooks 48, 50 of the return element 30 are coupled.

The return element 30 further comprises an auxiliary portion 60 for the mechanical engagement with a locking device, which will be described hereinafter.

The auxiliary portion 60 protrudes preferably from the coupling portion 46 and comprises an auxiliary seat 62, preferably preceded by a guide passage 64 flared toward said auxiliary seat 62.

Preferably, the return element 30 is made in one piece, for example by molding, in a plastic material suitably deformable elastically to the force values in play; for example, the return element is made of polypropylene (PP), polyoxymethylene (POM) or polybutylene terephthalate (PBT).

The head further comprises a locking device adapted, in a locked configuration, to engage the trigger to obstruct the dispensing stroke thereof and, in an unlocked configuration, to be disengaged from the trigger or from the piston to allow the dispensing stroke.

In particular, the head 1 comprises the locking device 70, manually rotatable by the user between the locked configuration and the released configuration.

In other words, the locking device 70 is supported by the return element 30, preferably in a rotatable manner.

For example, the locking device 70 comprises a mounting portion 72 for mounting to the return element 30, comprising, for example, a pin 74 adapted to be accommodated in the auxiliary seat 62 of the return element 30, in a swiveling manner.

The locking device 70 also comprises a main body 76, to which is applied, or in which is formed, the pin 74, provided with a pair of prongs 78, 80 which open fork-like and end with a respective locking head 82, 84.

Figure 7:
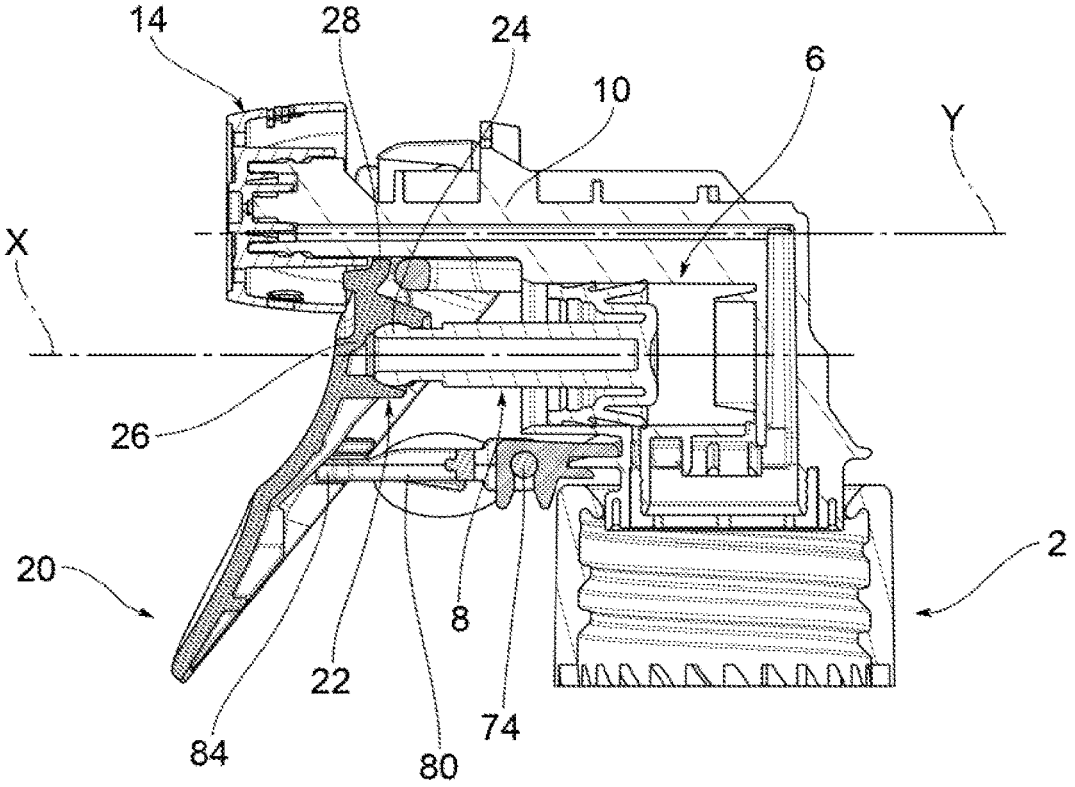
FIGS. 7 and 8 show cross-sections of the dispensing head according to the present invention.
Figure 8:
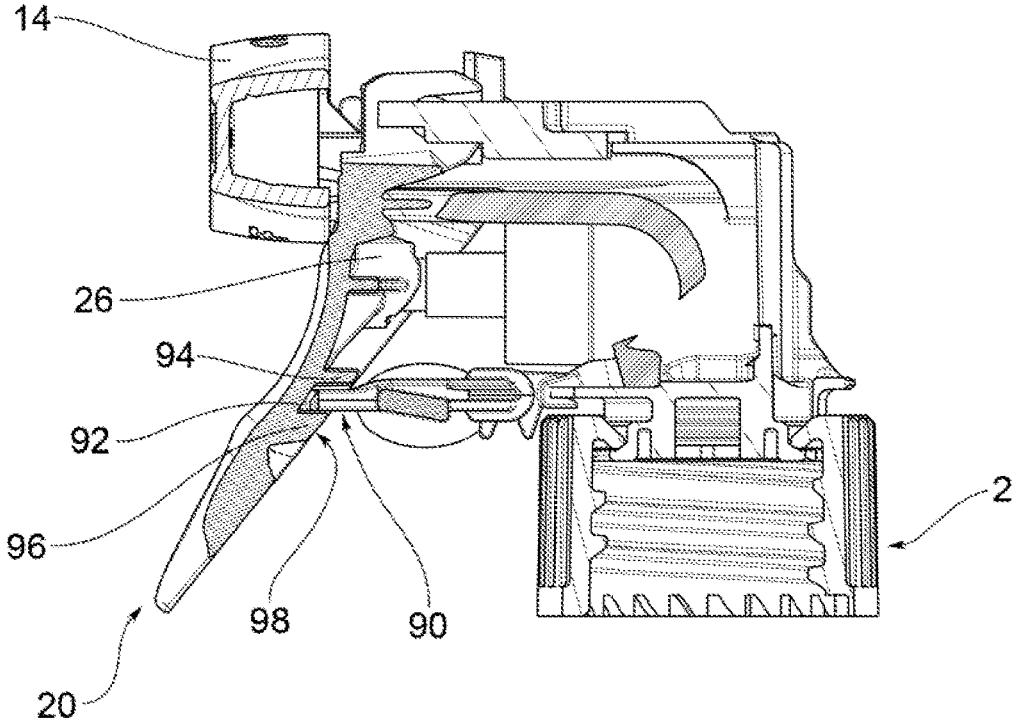
Figure 9:
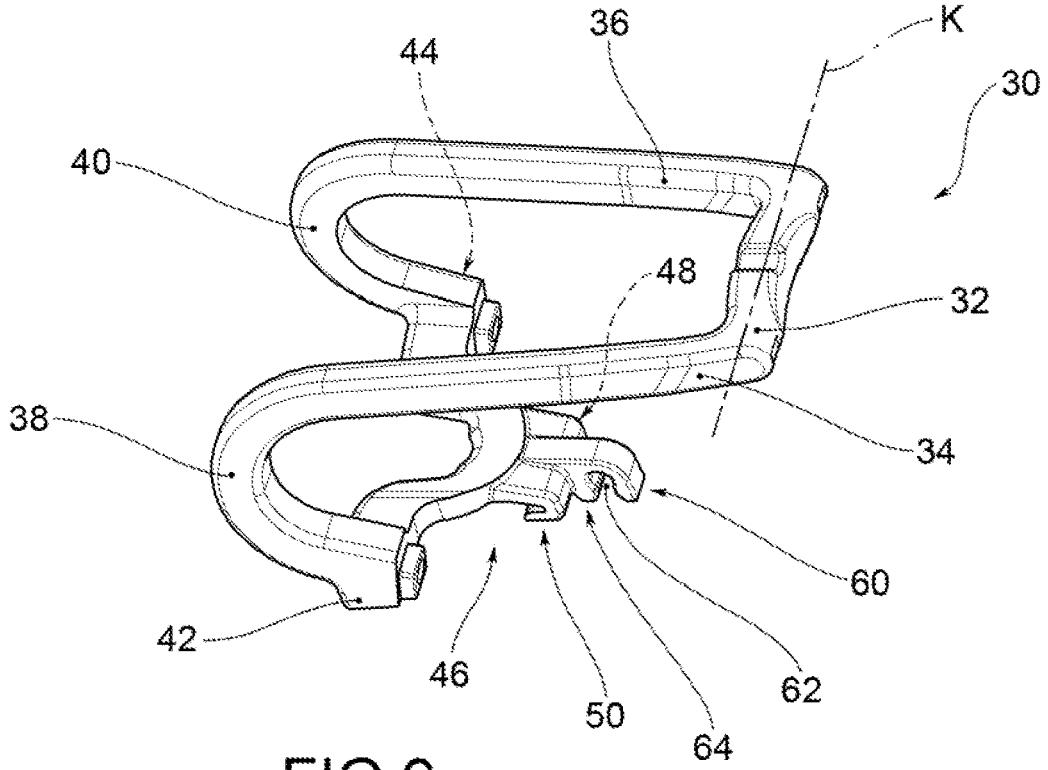
FIG. 9 illustrates an embodiment of a non-return element of the dispensing head.
Figure 10:
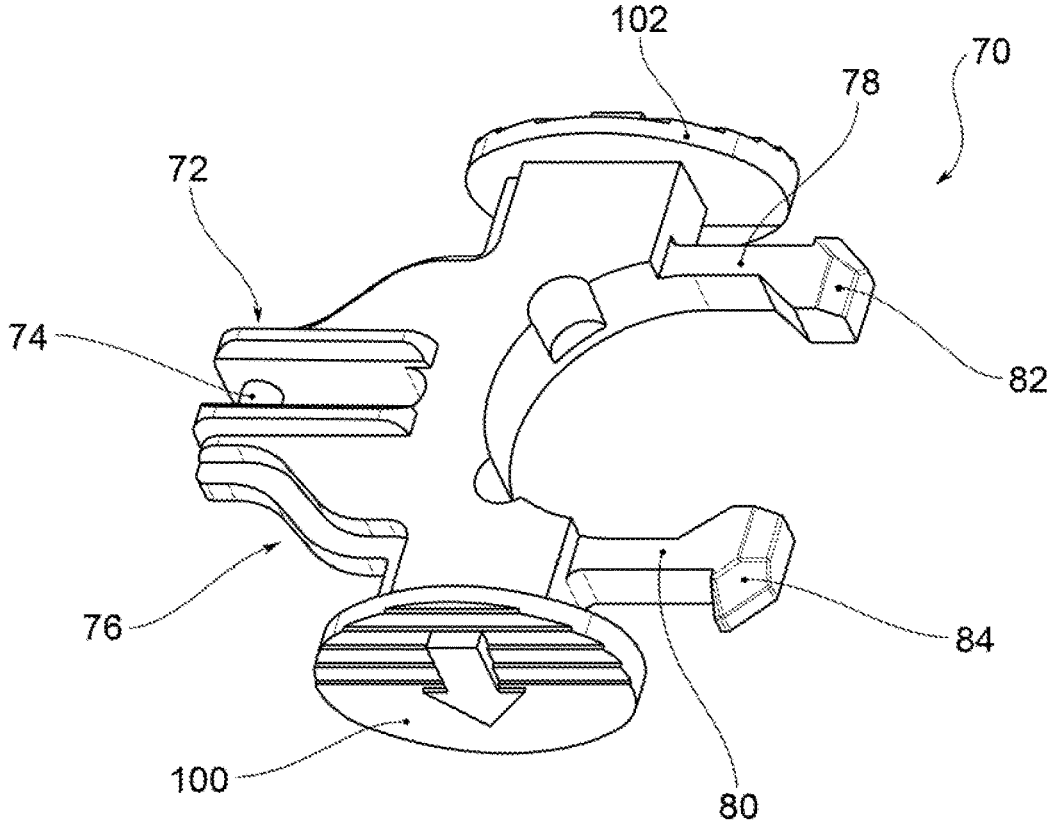
FIG. 10 illustrates an embodiment of a locking device of the dispensing head.

When the locking device 70 is in the locked configuration (FIGS. 7 and 8), the locking heads 82, 84 engage the trigger 20 locking the movement thereof in the direction of the dispensing stroke.

For example, the trigger 20 comprises an engagement portion 90, for example, made below the engagement seat 26 provided for the piston 8.

The lock engagement portion 90 comprises a lock engagement seat 92 adapted to accommodate said locking heads 82, 84, delimited by an upper wall 94 and a lower wall 96 provided with a guide surface 98 to facilitate the insertion of the locking heads 82, 84 into the lock engagement seat 92.

The locking device 70 further comprises gripping portions 100, 102, e.g. at the sides of the main body 76, for example, elliptical in shape.

Preferably, the locking device 70 is made in a single piece, for example by molding, for example out of polypropylene (PP) or polyoxymethylene (POM). During the transport of the dispensing devices or whenever the user wishes to make sure that the trigger is not accidentally depressed, the locking device 70 is in the locked configuration, wherein the movement of the trigger to complete the dispensing stroke is mechanically locked.

In particular, in said configuration, the locking heads 82, 84 are accommodated in the lock engagement seat 92 of the trigger 20.

In such configuration, if the trigger 20 is accidentally depressed, the movement is locked; in particular, the action of the trigger 20 is transmitted to the locking device 70, compressing the prongs 78, 80, and from there to the auxiliary portion 60 of the return element 30 and finally to the chassis 4 through the abutment portions 42, 44.

Figure 2:
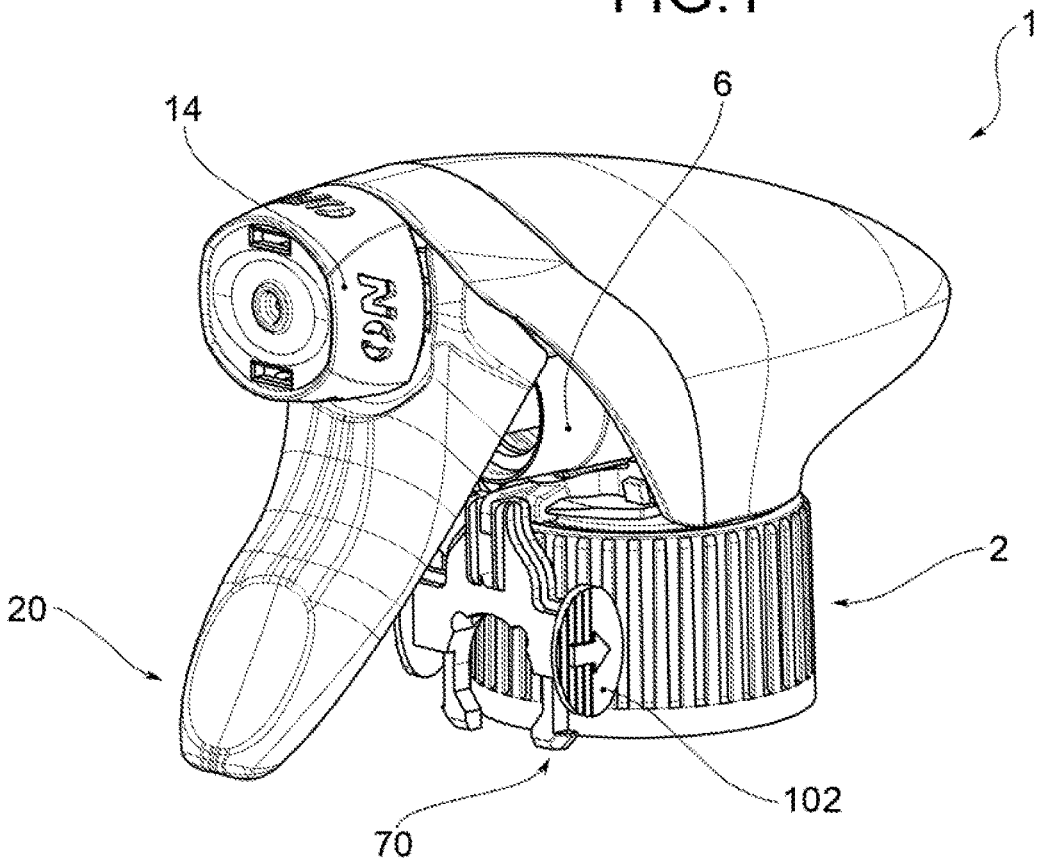
FIG. 2 shows the dispensing head of FIG. 1, with the locking device in a released configuration.

To bring the locking device 70 into the released configuration, it is sufficient to exert a slight pressure on the gripping portions 100, 102, so that the locking heads 82, 84 emerge from the lock engagement seat 92 of the trigger 20, and then rotate the locking device 70, gripping it by the gripping portions 100, 102 (FIG. 2), according to a releasing direction of rotation, which causes it to lower toward the ring 2.

Figure 5:
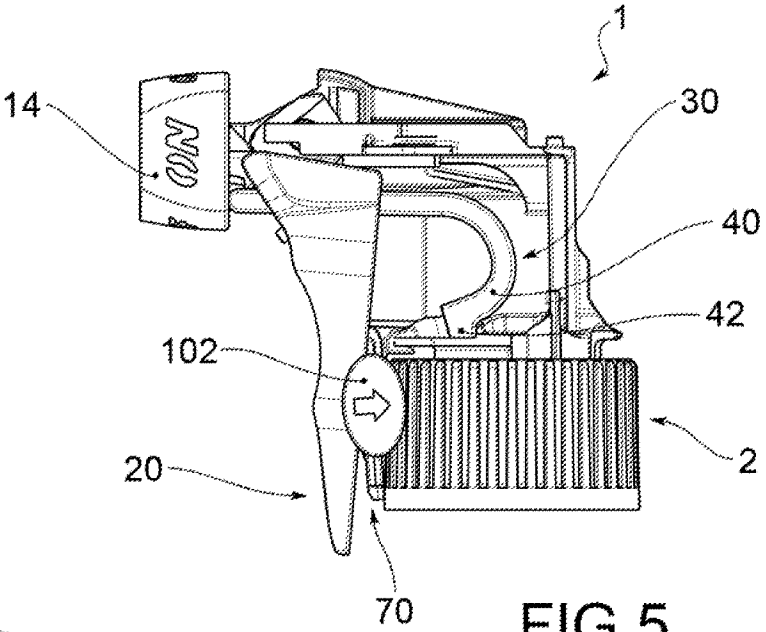
FIG. 5 shows the dispensing head according to the present invention, with the locking device in the released configuration and the trigger in a dispensing limit position.
Figure 4:
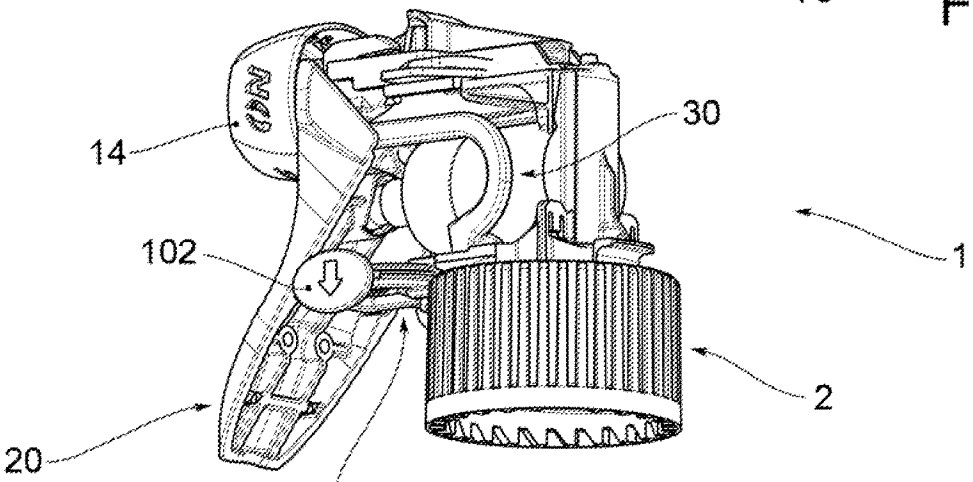
FIGS. 3 and 4 show the dispensing head according to the invention, without a cover, with a locking device in the locked configuration.
Figure 3:
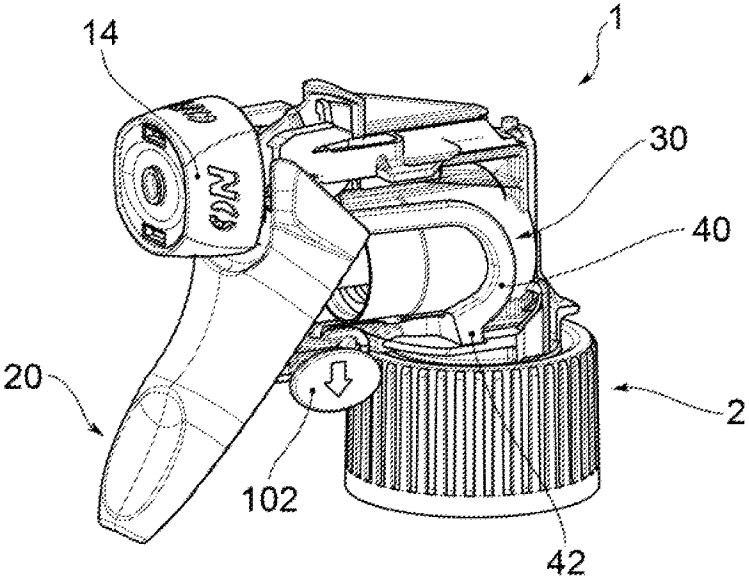
Figure 6:
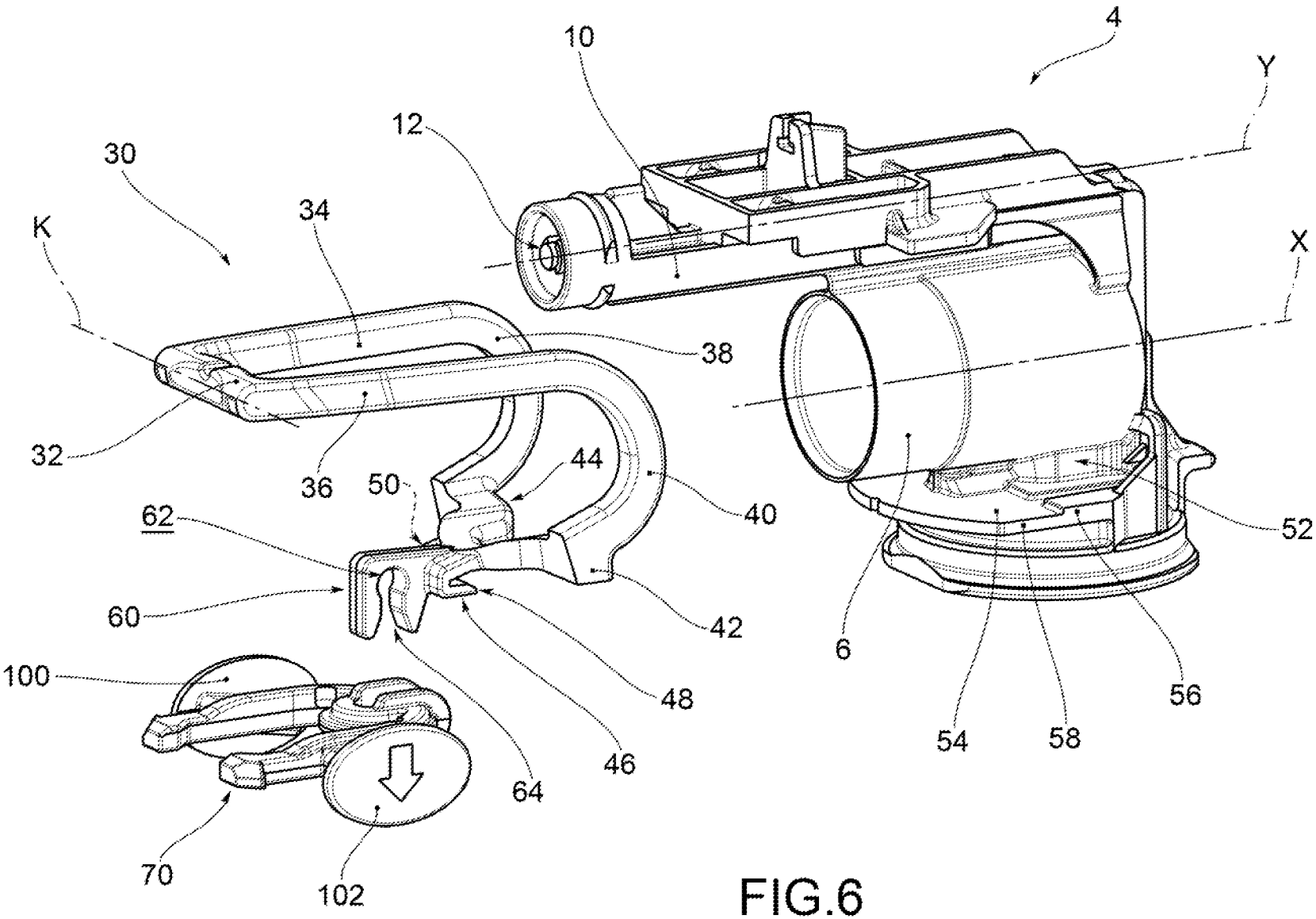
FIG. 6 illustrates separately a locking device, a return element, and a dispensing head chassis according to the present invention.

In such configuration, when pressing the trigger 20, the dispensing stroke is allowed (FIG. 5).

To return the locking device 70 to the locked configuration, the locking device is simply rotated in the opposite direction of rotation, which causes it to rise until the locking heads 82, 84 intercept the trigger and, facilitated by the guide surface 98, snap into the lock engagement seat 92.

Innovatively, the dispensing head according to the present invention satisfies the needs of the sector, as it is provided with a reversible locking device and allows a quick and effective mounting.

The mounting of the locking device to the chassis occurs in effect from the front, as is the case with the return element, which greatly facilitates the operations.

Moreover, advantageously the dispensing head according to the invention, even if equipped with a locking device, may be mounted to the bottle using the same machines that may be used for the type without a locking device.

This is because the overall size of the dispensing head, and in particular the total height, does not vary with respect to the head without a locking device, due to the return element supporting the locking device.

It is clear that a person skilled in the art may make changes to the dispensing head described above.

For example, according to a variant embodiment, the head is provided with a bayonet coupling (in place of the threaded ring) for engagement with the neck of the bottle.

According to a further variant, the trigger is engaged slidably with the chassis and thus movable in translation for dispensing the liquid.

According to another variant, in the locked configuration, the locking device engages the piston instead of the trigger, to prevent the dispensing stroke.

Subsequently, according to a variant embodiment, the return means are adapted to engage the piston instead of the trigger, to obtain its return to the initial position.

These and other equivalent variants are contained within the scope defined by the following claims.

The invention claimed is:

1. A trigger dispensing head for a liquid dispensing device, comprising:

a chassis wherein functional components for aspirating and dispensing a liquid are formed or whereby are supported;

a trigger movable between an initial rest position and a final dispensing position along a dispensing stroke, for dispensing the liquid;

a cylinder and a piston sealably sliding in the cylinder, on which the trigger acts during the dispensing stroke;

an elastic return means permanently engaged with the trigger or the piston to return said trigger back to the initial rest position, comprising a return element supported by the chassis, the return element comprising an auxiliary portion for mechanical engagement with a locking device and a coupling portion for gripping on the chassis, wherein the auxiliary portion protrudes from the coupling portion; and the locking device adapted, in a locked configuration, to engage the trigger or the piston to prevent the dispensing stroke and, in a released configuration, being disengaged from the trigger or from the piston, to allow the dispensing stroke, wherein said locking device is supported by the return element.

2. The trigger dispensing head of claim 1, wherein the locking device is rotatable between the locked configuration and the released configuration.

3. The trigger dispensing head of claim 1, wherein the return element is arranged astride the cylinder.

4. The trigger dispensing head of claim 1, wherein the return element comprises an engagement portion for engaging with the trigger and two arms extending alongside the cylinder, each arm protruding from the engagement portion.

5. The trigger dispensing head of claim 4, wherein the return element comprises two arched portions, each arched portion forming an extension of a respective arm of said two arms.

6. The trigger dispensing head of claim 1, wherein the return element comprises abutment portions adapted to define an abutment for the return element against the chassis.

7. The trigger dispensing head of claim 1, wherein the return element comprises coupling means for coupling with the chassis.

8. The trigger dispensing head of claim 7, wherein said coupling means comprise a coupling portion comprising two hooks to grip on the chassis.

9. The trigger dispensing head of claim 1, wherein:

the return element comprises an auxiliary portion for mechanical engagement with the locking device, comprising an auxiliary seat preceded by a guide passage flared towards said auxiliary seat; and the locking device comprises a mounting portion provided with a pin adapted to be accommodated in the auxiliary seat of the return element, in a rotatable manner.

10. The trigger dispensing head of claim 1, wherein the locking device comprises a main body provided with a pair of prongs which open fork-like and end each with a respective locking head engageable with the trigger.

11. The trigger dispensing head of claim 1, wherein the trigger comprises a locking engagement portion comprising a locking engagement seat adapted to accommodate locking heads.

12. The trigger dispensing head of claim 11, wherein said locking engagement seat is delimited by a bottom wall provided with a guide surface for facilitating insertion of the locking heads into the locking engagement seat.

13. The trigger dispensing head of claim 1, wherein the chassis comprises a mounting plate below the cylinder to which the return element is applied.

14. A dispensing device comprising:

a bottle containing a liquid, and a trigger dispensing head comprising:

a chassis wherein functional components for aspirating and dispensing the liquid are formed or whereby are supported;

a trigger movable between an initial rest position and a final dispensing position along a dispensing stroke, for dispensing the liquid;

a cylinder and a piston sealably sliding in the cylinder, on which the trigger acts during the dispensing stroke;

an elastic return means permanently engaged with the trigger or the piston to return said trigger back to the initial rest position, comprising a return element supported by the chassis, the return element comprising an auxiliary portion for mechanical engagement with a locking device and a coupling portion for gripping on the chassis, wherein the auxiliary portion protrudes from the coupling portion; and the locking device adapted, in a locked configuration, to engage the trigger or the piston to prevent the dispensing stroke and, in a released configuration, being disengaged from the trigger or from the piston, to allow the dispensing stroke, wherein said locking device is supported by the return element, and said trigger dispensing head being removably applied to the bottle.

* * * * *